US006029402A

United States Patent [19]

Carney et al.

[11] Patent Number: 6,029,402

[45] **Date of Patent: *Feb. 29, 2000**

[54] FACADE DOOR

[75] Inventors: Brian J. Carney, Cambridge, Mass.; Jonathan B. Hadley, Holland, Mich.

[73] Assignee: Steelcase Development Inc., Grand Rapids, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,084

[22] Filed: Dec. 23, 1996

[51] Int. Cl.[7] ..... E06B 3/00; E05D 7/00

[52] U.S. Cl. ..... 49/501; 49/399

[58] Field of Search ..... 49/399, 381, 371, 49/397, 396, 501, 504, 505; 52/457, 98, 100, 656.4, 656.7; 16/389, 390, 391

[56] References Cited

U.S. PATENT DOCUMENTS

| | | | |
|---|---|---|---|
| 1,604,703 | 10/1926 | Lynch | 16/389 |
| 2,372,977 | 4/1945 | North | 16/389 |
| 2,883,714 | 4/1959 | May . | |
| 3,065,035 | 11/1962 | Biesecker | 16/389 |
| 3,404,501 | 10/1968 | Von Wedel | 52/204.64 |
| 3,410,026 | 11/1968 | Casebolt | 49/397 |
| 3,774,360 | 11/1973 | Hubbard et al. | 52/127 |
| 3,780,472 | 12/1973 | Biebuyck | 49/501 |
| 3,889,422 | 6/1975 | Nielsen | 49/396 |
| 3,949,526 | 4/1976 | Sherlock et al. | 49/501 |
| 3,990,185 | 11/1976 | Nagase | 49/360 |
| 4,031,665 | 6/1977 | Abramson | 49/501 |
| 4,106,238 | 8/1978 | Bonello | 49/399 |
| 4,397,116 | 8/1983 | Habicht et al. | 49/501 |
| 4,416,086 | 11/1983 | Niekrasz | 49/388 |
| 4,637,167 | 1/1987 | Svensson | 49/386 |
| 4,753,043 | 6/1988 | Bockwinkel | 49/501 |
| 4,928,430 | 5/1990 | George | 49/460 |
| 4,937,978 | 7/1990 | Johansson et al. | 49/399 |
| 5,623,783 | 4/1997 | Kenkel | 49/501 |
| 5,657,591 | 8/1997 | Kitada | 49/501 |

*Primary Examiner*—Daniel P. Stodola
*Assistant Examiner*—Curtis A. Cohen
*Attorney, Agent, or Firm*—Price Heneveld Cooper Dewitt & Litton

[57] ABSTRACT

A door structure includes a frame defining glazing channels in which a glazing panel is mounted, and a plurality of hinge lugs which project outwardly from a major planar surface of the frame, with each of the lugs including an aperture for receiving a vertically arranged pivot pin and each of the lugs having a thickness which is less than a horizontal dimension of the lug which passes through the aperture. The door structure includes an extremely compact hinge which provides an aesthetically desirable appearance in which the structural support for the door is visually minimized. Also, there is a door structure including a frame having confronting glazing channels which define a vertical glazing plane which is oblique to a vertical plane defined by the frame, and a glazing panel secured within the glazing channels with the glazing panel being located in a vertical plane which is oblique to the vertical plane defined by the frame. This structure provides a strikingly unique and aesthetically desirable appearance.

8 Claims, 4 Drawing Sheets

FACADE DOOR

FIELD OF THE INVENTION

This invention relates to door structures of the type having a glazing panel mounted within a frame structure and in which the glazing panel comprises a major portion of the door structure, and more particularly to a glazing panel mounting structure and a hinge structure for such doors which each provide striking visual effects.

BACKGROUND OF THE INVENTION

Doors comprising a frame in which a glazing panel is mounted are well known. However, known doors of this type generally include a glazing panel which is mounted in a plane parallel to the outer exposed surfaces of the frame. Further, known doors of this type are generally pivotally mounted to a door jamb with relatively bulky hinge structures, such as standard bifolding door hinges which impart a clumsy, cluttered appearance.

SUMMARY OF THE INVENTION

An aspect of this invention relates to a novel hinge structure which is extremely compact and provides an aesthetically desirable door structure in which the structural support for the door is visually minimized. More specifically, the compactness of the hinges imparts or contributes to a door structure having a clean, uncluttered and unencumbered appearance. Wherein there is no visible hardware either on the edge of the door or on the abutting edge of the door frame, as viewed form either side of the door. This design eliminates hinge butts which usually appear when a door is in the open position. The door structure includes frame-defining glazing channels in which a glazing panel is mounted, and a plurality of horizontally arranged, apertured hinge lugs at the top and bottom of the hinge stile, each of which projects outwardly from a major planar surface of the door frame and is generally located at, or adjacent to, the hinge side edge of the door structure.

A preferred embodiment of the compact hinge structure of this invention involves the use of a generally flat L-shaped hinge plate having a first leg portion which is securely mounted within a door, and a second leg portion which projects outwardly from a major planar surface of the door at about a right angle from the first leg, and is generally located at or adjacent to the hinge side edge of the door. The outwardly projecting leg portion of the hinge plate includes a pivot aperture for receiving a vertically arranged hinge pin for pivotally mounting the door to a pivot bracket having an apertured portion projecting from a door jamb in which the door is mounted.

Desirably, the projecting portion of the pivot bracket is flat and projects outwardly from one side of the jamb. The projecting portion of the pivot bracket includes an apertured portion which extends toward and overlaps the outwardly projecting leg portion of the hinge plate. The apertured portion includes a pivot aperture which is aligned with the pivot aperture of the hinge plate. A hinge pin assembly extends through the aligned apertures on the hinge plate and on the pivot bracket to pivotally secure the door to the jamb.

A further aspect of this invention relates to a novel door structure including a frame having confronting glazing channels which define a vertical glazing plane which is oblique to a vertical plane defined by the major exposed surfaces of the frame. A glazing panel is secured within the glazing channels, the glazing panel being located in a vertical plane which is oblique to the vertical plane defined by the frame. The angled relationship of the glazing panel with respect to the door in which it is mounted provides a novel structure with a strikingly unique and aesthetically desirable appearance.

A further aspect of this invention relates to a door construction including a frame having a bottom rail. The bottom rail includes an upper portion, and further includes a lower portion separated from the upper portion by a groove. The groove is shaped to act as a stress riser when the lower portion is impacted. The bottom rail is made from a material that characteristically fractures upon impact, such that the lower portion can be selectively broken off of the upper portion without the need for use of a cutting tool.

A preferred embodiment of the door structure includes spaced apart, generally parallel stiles, including a leading edge stile and a hinge stile, and a pair of connecting rails, including a top rail and a bottom rail which are attached respectively to upper and lower ends of the spaced stiles. The stiles defined confronting glazing channels. Likewise, the rails define confronting glazing channels which are obliquely arranged with respect to the rails. The glazing channels of the stiles and rails together define a vertical glazing plane which is oblique to a vertical plane defined by the frame. A glazing panel is secured within the glazing channels to provide the desired door structure in which the glazing panel is oblique to the door frame.

DESCRIPTION OF THE PREFERRED EMBODIMENT

Figure 1:
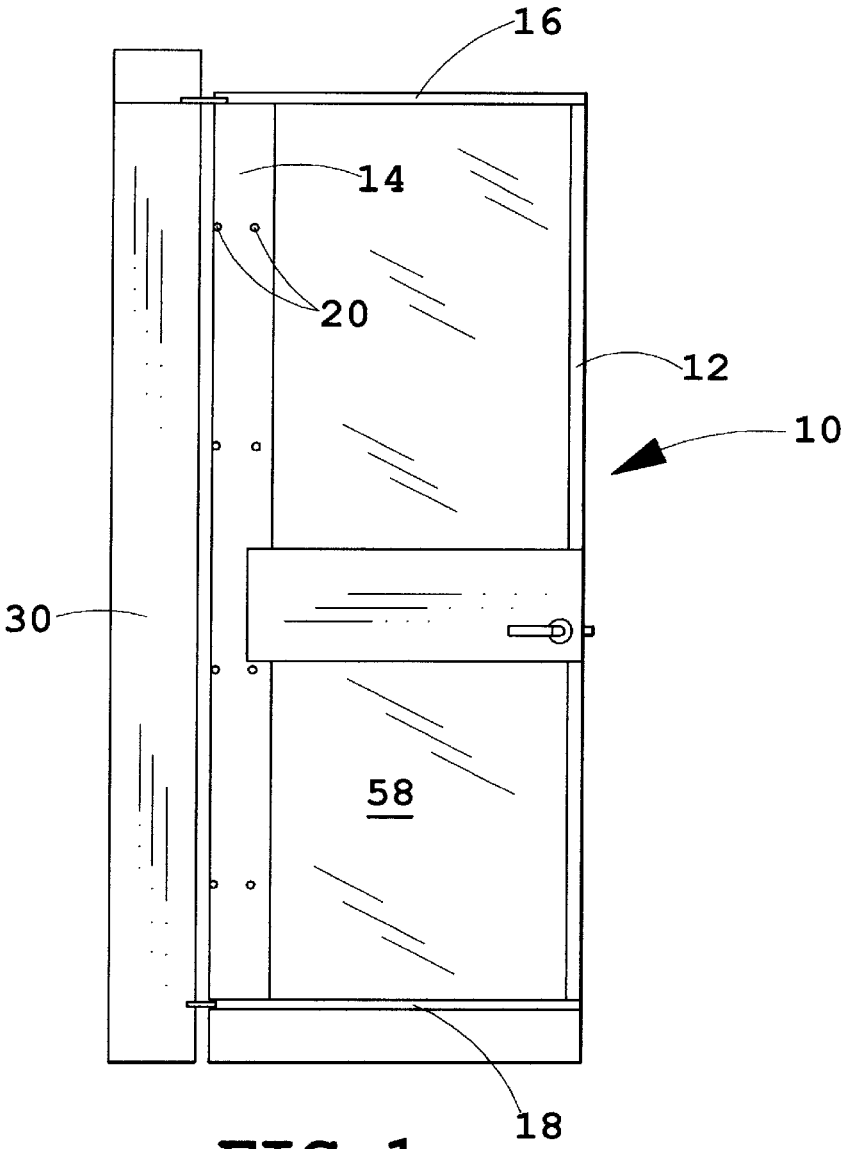
FIG. 1 is a front elevational view of a door structure in accordance with this invention.
Figure 2:
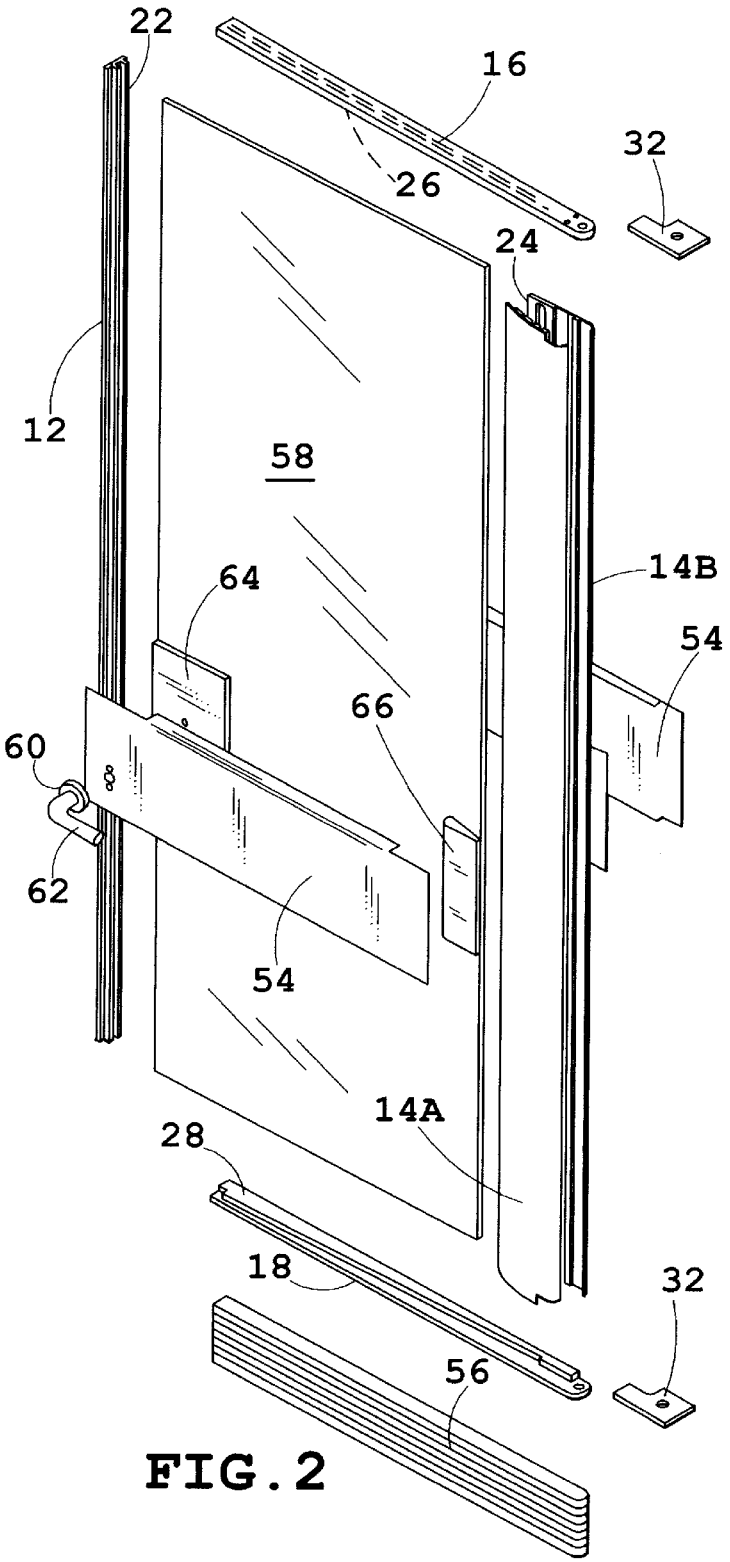
FIG. 2 is an exploded perspective view of the door structure shown in FIG. 1.

There shown in FIG. 1 an embodiment of the door structure 10 of this invention. The door structure generally comprises a frame including a leading edge stile 12, a hinge stile 14, a top rail 16, and a bottom rail 18. The stiles 12, 14 are arranged in spaced, generally parallel relationship to each other. Likewise, the top and bottom rails 16, 18 are arranged in spaced, generally parallel relationship to each other and are attached respectively to the upper and lower ends of the spaced stiles to form a rigid, generally rectangular shaped frame. As shown in FIG. 2, the hinge stile 14 may be comprised of two parts or wings 14A, 14B which are secured together such as with fasteners 20 (FIG. 1). Top rail 16 and bottom rail 18 can be attached to the upper and lower ends of stiles 12, 14 using any suitable means, such as fasteners (not shown).

Stiles 12, 14 define confronting vertical glazing channels 22, 24. Likewise, top rail 16 and bottom rail 18 define confronting horizontal glazing channels 26, 28. As can be seen in FIG. 2, glazing channel 28 is at an angle with respect to the length of the bottom rail 18. More specifically, glazing channel 28 extends along a diagonal line from the front leading edge corner bottom rail 18 to the rear hinge corner of the bottom rail. Glazing channel 26 extends in a similar manner from the front leading edge corner to the rear hinge edge corner of the top rail 16. The frame generally defines a vertical plane which coincides with or is parallel to the front or rear edges of the top and bottom rails, and which is also coincident with or parallel to a door opening defined by a door jamb 30. The confronting glazing channels 22, 24 and 26, 28 together define a continuous vertical glazing plane which is oblique to the vertical plane defined by the frame and/or by the door opening in the jamb.

Figure 3:
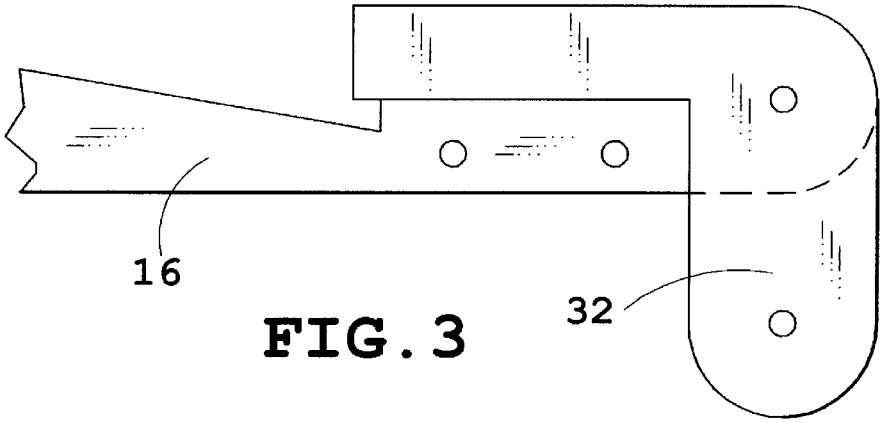
FIG. 3 is a fragmentary, top plan view showing attachment of a hinge plate to a bottom or top rail used for connecting spaced opposing stiles.
Figure 4:
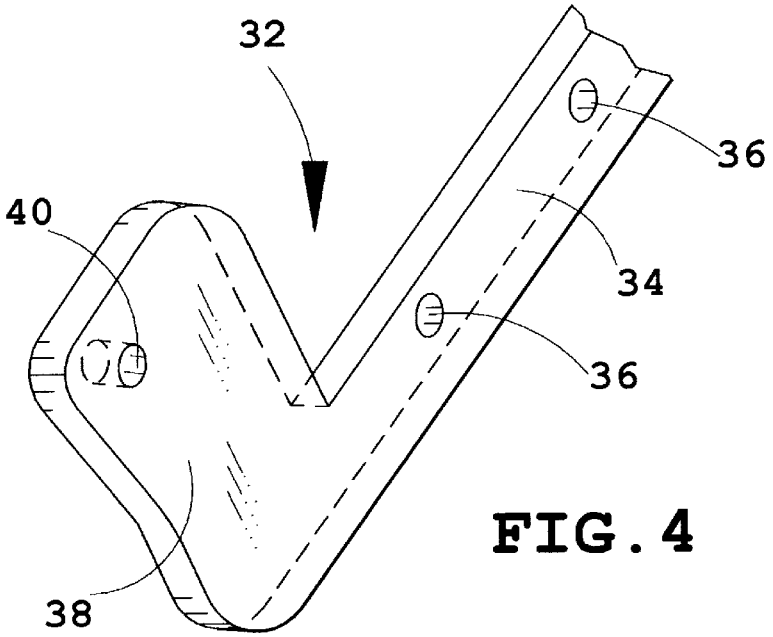
FIG. 4 is a perspective view of a pivot plate in accordance with a preferred embodiment of this invention.

Securely disposed within the frame, between the upper end of hinge stile 14 and the hinge end of top rail 16 is a generally L-shaped hinge plate 32. Similarly, a generally L-shaped hinge plate 32 is securely disposed between the lower end of hinge stile 14 and the hinge end of bottom rail 18. The arrangement of the L-shaped hinge plate 32 with respect to the bottom rail 18 is shown in greater detail in FIG. 3. Further details of the L-shaped hinge plate 32 will be made with reference to FIG. 4. The L-shaped hinge plate includes a first leg portion 34 which is mounted within the frame of the door structure. The illustrated hinge plate 32 includes a pair of apertures 36 in the first leg portion 34 for fastening the hinge plate to the frame structure. Hinge plate 32 also includes a second leg portion 38 which projects outwardly from the frame of the door. The outwardly projecting leg portion 38 includes a pivot aperture 40 for receiving a vertically arranged hinge pin for pivotally mounting the frame to door jamb 30. More specifically, the outwardly projecting second leg portion 38 constitutes a hinge lug which projects outwardly from one of the two opposing, major planar surfaces of the frame.

An important characteristic of the hinge plates 34 and hinge lug 38 is that they are formed of a flat plate material, such as steel plate, to provide a strong, but compact structure in which the thickness of the plate 34 and lug is less than any dimension thereof which is perpendicular to the plate thickness (i.e., measured in a horizontal plane) and which passes through the pivot aperture 40. A suitable plate thickness is from about ¼ inch (about 0.6 cm) to about ½ inch (about 1.3 cm).

Figure 5:
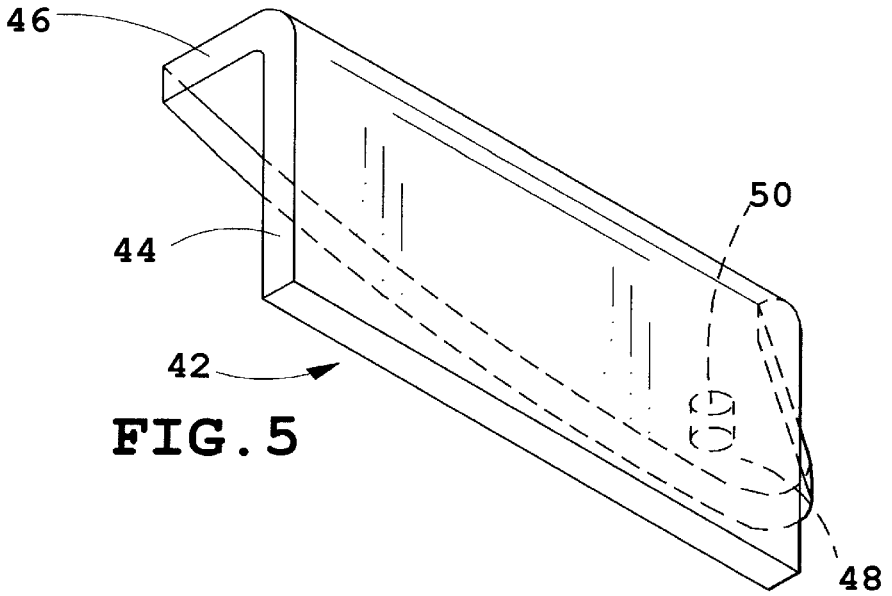
FIG. 5 is a perspective view of a pivot bracket which is secured to a door jamb and which is used for pivotally supporting the door structure.
Figure 6:
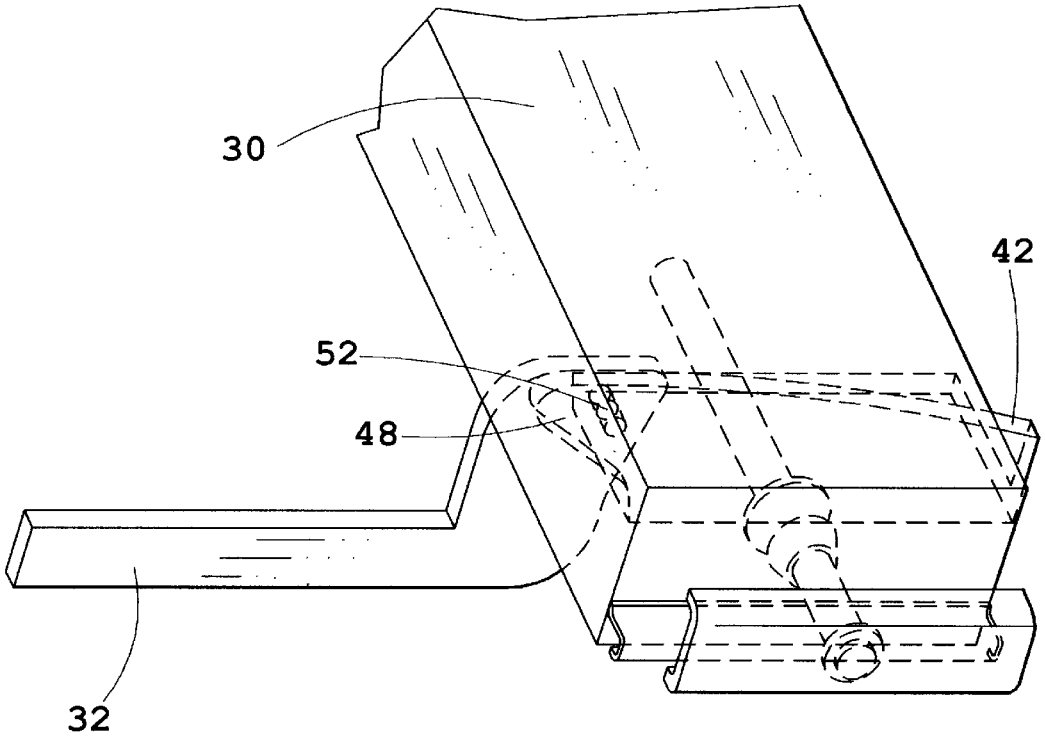
FIG. 6 is an enlarged perspective generally showing the manner in which the pivot bracket shown in FIG. 5 is mounted to a member portion of a door jamb.

In accordance with the illustrated embodiment, a pivot bracket 42 (FIG. 5) is secured to the jamb 30. Pivot bracket 42 is generally an elongate member having an L-shaped cross section including a vertically arranged leg 44 of generally rectangular shape and a horizontally arranged leg 46 having a somewhat truncated elliptical shape including a support lug portion 48 having a pivot aperture 50 which is aligned with the pivot aperture of the hinge plate. A hinge pin 52 (FIG. 6) extends through the aligned apertures 40, 50 on the hinge plate and on the pivot bracket, respectively, to pivotally secure the door to the jamb. As shown in FIG. 6, pivot bracket 42 of the preferred embodiment is securely mounted between adjoining members of the jamb 30 with the support lug portion 48 projecting outwardly from one side of the jamb with the pivot aperture 50 located slightly inwardly of the hinge edge of the jamb toward the opening defined by the jamb. In the illustrated embodiment, door structure 10 is provided with two hinge plates 32, one located adjacent the upper hinge edge corner of the door structure and a second located adjacent a lower hinge edge corner of the door structure, and the jamb 30 is provided with a pair of corresponding pivot brackets 42 on which the door structure is pivotally supported.

The illustrated door structure includes a pair of middle rails 54 (one on each side of the door) and a kick panel 56 that are aligned with and aesthetically match corresponding panels and lines of the door frame and jamb.

Glazing panel 58 is secured within the glazing channels defined by the frame members 12, 14, 16 and 18. The glazing panel is generally a glass or plastic pane which is either transparent or translucent, however, panels comprised of other materials can be used.

Figure 7:
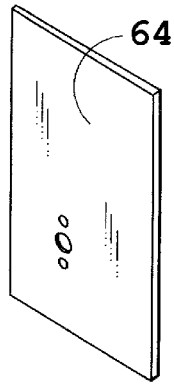
FIGS. 7–9 are enlarged perspective views of the middle belt spacers shown in FIG. 2.
Figure 8:
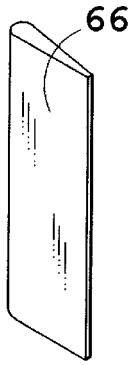
Figure 9:
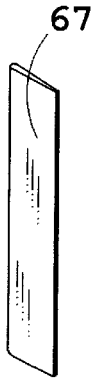

Latching hardware 60 includes a handle 62 attached to glazing panel 58. The latching hardware is shielded and supported by middle rail 54. Middle rail spacers 64, 66 and 67 are used on opposite sides at opposed ends of the middle rail 54 to help securely support glazing panel 58 in its angled position. As shown in FIGS. 7, 8 and 9, each of the spacers 64, 66 and 67 is generally wedge-shaped, and has a triangular horizontal cross sectional shape or profile.

Figure 10:
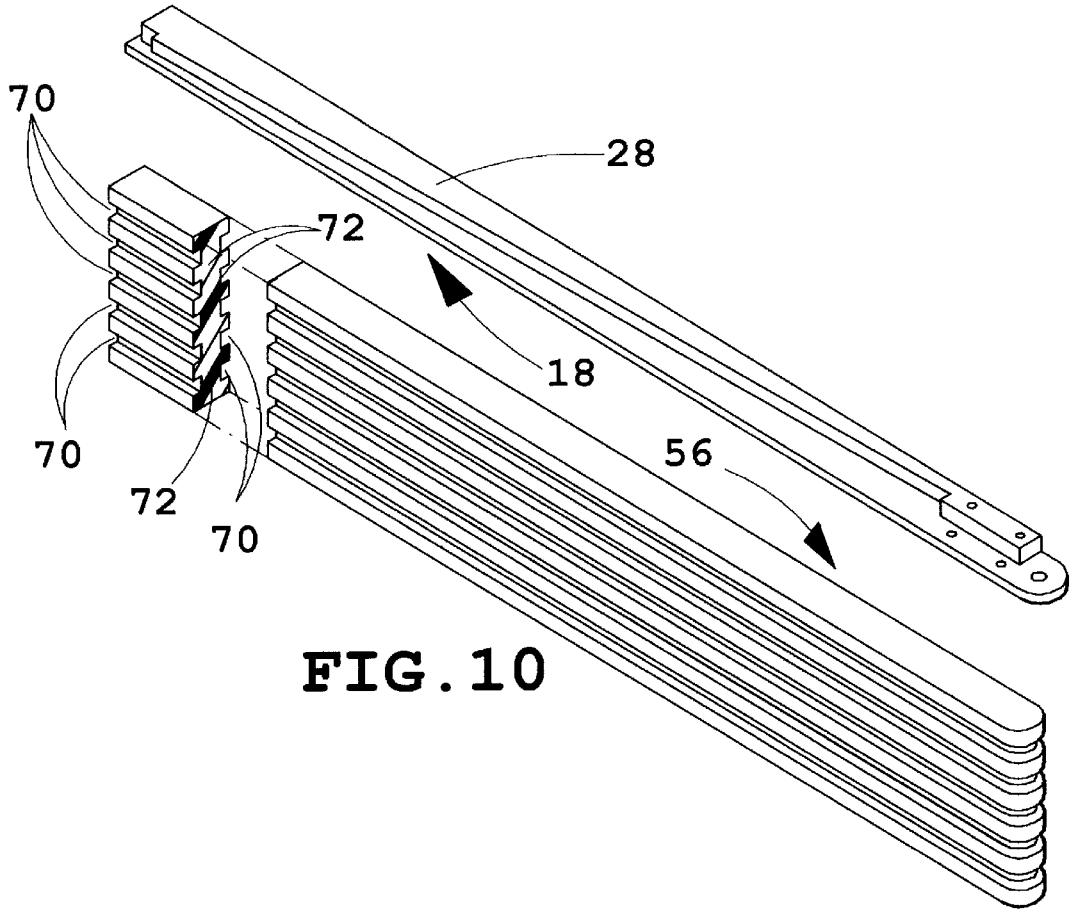
FIG. 10 is an enlarged perspective view, with portions broken away, of the kick panel shown in FIG. 2.

As seen by reference to FIG. 10, kick panel 56 preferably acts as an adjustable height spacing element for concealing or filling any gap between bottom rail 18 and the floor. The adjustable height of the kick panel 56 facilitates or allows the use of a single-size door in a plurality of differently dimensioned doorways. This feature is particularly useful in panel systems wherein adjustability of the panel walls and doorways can result in minor variations in the height of a doorway defined by the panel system.

Height adjustability of the kick panel 56 is achieved by means of a plurality of vertically spaced apart grooves 70 which are arranged in pairs on opposite sides of the kick panel 56 to define a plurality of vertically spaced apart thin sections 72. The kick panel 56 can be easily broken or separated into two pieces along a horizontal plane generally defined by the plurality of thin sections 72 which are defined by the grooves on opposite faces of the kick panel. The arrangement of corresponding pairs of vertically spaced apart grooves on opposite faces of the kick panel allows a portion of the kick panel to be easily broken away by hand and/or with the aid of simple tools. For example, it is envisioned that the kick panel 56 be configured with suitable groove and thin portioned dimensions, and be made of a material, such as plastic, which would have sufficient strength to prevent the kick plate from being broken inadvertently, but which would allow the kick panel to be easily separated into two pieces along a thin section 72 defined by grooves 70 on opposite sides of the kick panel after fracture of one of the thin sections 72 is induced. Fracture of one of the thin sections 72 can be induced, for example, by inserting the sharp end of a tool, such as a screwdriver into one of the grooves 70 and against one of the thin portions 72, and impacting the other end of the tool with a hammer or the like to cause the thin section to fracture. Thereafter, the kick panel would preferably be easily broken by hand.

The illustrated door structure 10 can be assembled by fastening top and bottom rails 16, 18 to leading edge stile 12 using screws or other fasteners. Glazing panel 58 can then be slid into the channels defined by stile 12 and rails 16, 18. Thereafter, the wing portions 14A and 14B of hinge stile 14 can be properly positioned over the remaining exposed edge of the glazing panel 58 and fastened together with screws or other fasteners so that the wings 14A, 14B clampingly engage the hinge side vertical edge of the glazing panel 58. Fasteners can then be used to secure the top and bottom rails

16, 18 to the upper and lower ends of the hinge stile 14. The remaining part including panels 54, 56, latching hardware 60, handle 62, and belt spacer 64, 66 can be thereafter attached to complete the door structure.

It will become apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A door construction comprising:

a glazing panel; and a door frame including a top rail, a bottom rail, and side stiles, at least one pair of which define opposing channels shaped to securely engage and support opposing edges of the glazing panel, the door frame including a face surface defining a vertical plane that extends parallel a length of the top rail and the bottom rail, but the opposing channels being configured to engage and hold the glazing panel at an oblique angle to the vertical plane wherein the bottom rail includes an upper portion, and further includes at least one lower portion separated from the upper portion by a groove, the groove being shaped to create an area of high stress concentration by reducing a cross-sectional area of the bottom rail and the bottom rail being made from a material that characteristically can be readily fractured upon impact, such that the lower portion can be selectively broken off of the upper portion with a hand tool, but without the need for a cutting tool.

2. A door construction comprising:

a door frame including a bottom rail, the bottom rail including an upper portion and further including a lower portion separated from the upper portion by a first groove, the first groove being shaped to create an area of high stress concentration by reducing a cross-sectional area of the bottom rail and the bottom rail being made from a material that characteristically fractures upon impact, such that the lower portion can be selectively broken off of the upper portion without the need to use a cutting tool, the lower portion including additional grooves, each being shaped to act as a stress raiser, so that by selectively focusing an impact toward a particular one of the first groove and the additional grooves, a chosen section of the lower portion can be selectively broken off.

3. The door construction defined in claim 2 wherein the first-mentioned groove includes a thin section and is shaped to receive a screwdriver, such that the thin section can be fractured using the screwdriver.

4. The door construction defined in claim 3 wherein the bottom rail includes several of the additional grooves on opposing sides of the bottom rail.

5. The door construction defined in claim 2 wherein the first groove is defined in part by a thin section and wherein the groove is shaped to receive a thin tool, such that the thin section can be fractured using the thin tool.

6. The door construction defined in claim 2 wherein the bottom rail includes a second groove located on an opposite side of the bottom rail, the second groove being arranged to form a pair with the first groove.

7. The door construction defined in claim 2 including a glazing panel, and wherein the bottom rail includes an angled channel shaped to receive an edge of the glazing panel, the angled channel extending at an angle to a longitudinal direction of the bottom rail, such that the glazing panel is secured at an angle to a face of the door construction.

8. A door construction comprising:

a door frame including a bottom rail, the bottom rail including an upper portion and further including a lower portion separated from the upper portion by at least one groove, the at least one groove being shaped to create an area of high stress concentration by reducing a cross-sectional area of the bottom rail and the bottom rail being made from a material that characteristically fractures upon impact, such that the lower portion can be selectively broken off of the upper portion without the need to use a cutting tool.

* * * * *